US010017712B2

(12) United States Patent
Boam et al.

(10) Patent No.: US 10,017,712 B2
(45) Date of Patent: Jul. 10, 2018

(54) METHOD FOR PRODUCING VITAMIN E-ENRICHED, ESPECIALLY TOCOTRIENOL-ENRICHED, COMPOSITIONS FROM NATURAL OILS

(71) Applicant: Evonik Degussa GmbH, Essen (DE)

(72) Inventors: Andrew Boam, Hertfordshire (GB); Yuri Bouwhuis, Princeton, NJ (US); Velichka Yordanova Koleva, Haltern am See (DE); Maria Ines Fontes Rocha, Sra da Hora (PT); Michael Schwarm, Alzenau (DE)

(73) Assignee: Evonik Degussa GmbH, Essen (DE)

( * ) Notice: Subject to any disclaimer, the term of this patent is extended or adjusted under 35 U.S.C. 154(b) by 0 days.

(21) Appl. No.: 15/118,021

(22) PCT Filed: Feb. 6, 2015

(86) PCT No.: PCT/EP2015/052462
§ 371 (c)(1),
(2) Date: Aug. 10, 2016

(87) PCT Pub. No.: WO2015/121156
PCT Pub. Date: Aug. 20, 2015

(65) Prior Publication Data

US 2017/0166837 A1 Jun. 15, 2017

(30) Foreign Application Priority Data

Feb. 11, 2014 (EP) ..... 14154662

(51) Int. Cl.
*C11B 11/00* (2006.01)
*C11B 3/00* (2006.01)

(52) U.S. Cl.
CPC ..... *C11B 11/00* (2013.01); *C11B 3/006* (2013.01)

(58) Field of Classification Search
CPC ..... C11B 3/006; C11B 11/00
See application file for complete search history.

(56) References Cited

U.S. PATENT DOCUMENTS

| | | | |
|---|---|---|---|
| 5,157,132 | A | 10/1992 | Tan et al. |
| 5,733,663 | A | 3/1998 | Scheunemann et al. |
| 6,224,717 | B1 | 5/2001 | Sumner, Jr. et al. |
| 6,350,453 | B1 | 2/2002 | Tan et al. |
| 6,368,382 | B1 | 4/2002 | Chiou |
| 6,585,802 | B2 | 7/2003 | Koros et al. |
| 6,755,900 | B2 | 6/2004 | Koros et al. |
| 7,507,847 | B2 | 5/2009 | Tou |
| 7,544,822 | B2 | 6/2009 | Ho |
| 8,048,462 | B2 | 11/2011 | Brunner et al. |
| 2010/0130761 | A1 | 5/2010 | Boam et al. |

FOREIGN PATENT DOCUMENTS

| | | | |
|---|---|---|---|
| DE | 102009047351 | A1 | 6/2011 |
| EP | 1741481 | A2 | 1/2007 |
| JP | 59-225705 | A | 12/1984 |
| JP | 62-136212 | A | 6/1987 |
| WO | 2008/002154 | A2 | 1/2008 |
| WO | 2010/125988 | A1 | 11/2010 |
| WO | 2012/154613 | A1 | 11/2012 |
| WO | 2013/068443 | A1 | 5/2013 |

OTHER PUBLICATIONS

Nagesha, G. K., R., "Processing of tocopherol and FA systems using a nonporous denser polymeric membrane." Journal of the American Oil Chemists' Society 80.4 (2003): 397-402.*
International Search Report and Written Opinion, PCT/EP2015/052462, dated Jul. 2, 2015, 8 pages.
Arora, et al; Desalination, 191, pp. 454-466 (2006).
Chiu, et al; "Carotenoids Concentration of Palm Oil Using Membrane Technology," Desalination 246 (2009) pp. 410-413.
Damoko and Cheryan, Journal of the American Oil Chemists' Society, 83(4), pp. 365-370 (2016).
Koike, et al; "Separation of Oil Constituents in Organic Solvents Using Polymeric Membranes," Journal of the American Oil Chemists Society, Springer, DE, vol. 79, No. 9, Jan. 1, 2002, pp. 937-942.
Othman, et al; Journal of Applied Sciences, 10(12), pp. 1187-1191 (2010).
Othman, et al; Journal of Membrane Science, 348, pp. 287-297 (2010).
See-Toh, et al; "In search of a standard method for the characterisation of organic solvent nanofiltration membranes", Journal of Membrane Science, 291 (1-2), pp. 120-125 (2007).
Sereewatthanawut, et al; "Nanofiltration Process for the Nutritional Enrichment and Refining of Rice Bran Oil," Journal of Food Engineering, Barking, Essec, GB, vol. 102, No. 1, pp. 16-24.
Tylkowski, et al; "Concentration of Biologically Active Compounds Extracted from SSP. L. by Nanofiltration," Food and Bioproducts Processing, Institution of Chemical Engineers, Rugby, GB, vol. 89, No. 4, Nov. 4, 2010, pp. 307-314.
Wong and Radhakrishnan; Nutrition Reviews, 70(9), pp. 83-490 (2012).
Wynn and Ratledge; "Microbial Oils: Production, Processing and Markets for Specialty Long-Chain Omega-3 Polyunsaturated Fatty Acids," pp. 43-76, in Breivik (Ed.) Long-Chain Omega-3 Specialty Oils, The Oily Press, P.J. Barnes & Associates, Bridgewater UK, 2007.

* cited by examiner

*Primary Examiner* — John M Mauro
(74) *Attorney, Agent, or Firm* — Michael Best & Friedrich LLP

(57) ABSTRACT

The present disclosure relates generally to a process for manufacturing products enriched in the content of at least one vitamin E component, preferably tocotrienol, using solvent extraction and membrane filtration.

27 Claims, 1 Drawing Sheet

METHOD FOR PRODUCING VITAMIN E-ENRICHED, ESPECIALLY TOCOTRIENOL-ENRICHED, COMPOSITIONS FROM NATURAL OILS

The present invention relates generally to a process for manufacturing products enriched in vitamin E, especially in tocotrienol, content. In another aspect it relates to the use of an immiscible organic solvent to extract vitamin E components, in particular tocotrienols, from natural oil such that two products are generated: (1) a first phase that is substantially the glyceride content of the initial oil, and; (2) a second phase that is substantially depleted in glycerides and enriched in vitamin E components content relative to the initial oil. In another aspect, it relates to the preferential separation of free fatty acids and vitamin E components, especially tocotrienols, contained in the extracting solvent using nanofiltration membranes, such that the free fatty acids permeate the membrane with the solvent and the membrane retains the vitamin E components. In particular, the process comprises utilising organic solvent nanofiltration membranes to retain vitamin E components while allowing the solvent and free fatty acid to permeate and thus maximise enrichment and recovery of vitamin E components, especially tocotrienols, whilst providing a solvent permeate stream rich in free fatty acids. The composition of material retained by the membrane comprises a mixture enriched in tocopherols and tocotrienols, i.e. once the solvent is removed from the retained material the concentration of tocopherols (depending on the solvent used for extraction) and in particular tocotrienols is higher than in the initial crude natural oil and this constitutes the desired tocotrienol-enriched product.

Vegetable oils are naturally rich in free fatty acids (FFA) and fat-soluble antioxidants such as tocopherol (TP) and tocotrienol (TT). Although they are high value compounds, they are typically destroyed in the conventional industrial oil refining process using high temperature distillation.

Natural oils are extracted from a wide variety of vegetable, microbial, algal, animal, marine, freshwater and fish feedstocks, e.g. palm nut, corn, soya beans, coconuts, peanut, olives, sunflower, rice bran, oily fish, krill and shellfish. In some cases, e.g. olives, a particularly pure form of oil (e.g. virgin olive oil) is formed by mechanically crushing and pressing the feedstock to liberate the oil. However, in most feedstocks the oil concentration is low and the prepared feedstock is usually mixed with an appropriate solvent to extract the oil, and the oil is then concentrated by evaporating the solvent. Steam distillation and supercritical fluid extraction (e.g. supercritical carbon dioxide) are sometimes used to extract oils, however in the majority of cases standard organic solvents are used.

The composition of extracted oil consists predominantly of free fatty acids and glycerides (mono, di and tri esters of glycerol with fatty acids). However, some natural oils also contain a number of minor components (including but not limited to vitamins, antioxidants, carotenoids, polyphenols, flavour and fragrance compounds, etc.) many of which have significant value but are present in low concentrations in the natural oil.

One particular group of minor components that has received a lot of attention recently is the vitamins, particularly the vitamin E group and specifically the tocotrienol compounds present in vitamin E.

Vitamin E consists of a group of eight structurally similar compounds consisting of four tocopherols and four tocotrienols. vitamin E is a fat-soluble vitamin with antioxidant properties. Tocopherols are the most common vitamin E compounds and they have been most widely studied. Tocotrienols were only identified as a separate group of compounds in the 1980s, and since then there have been indications of a broad range of benefits associated with tocotrienol consumption including cholesterol lowering properties, cardiovascular benefits, anti-cancer properties, benefits for patients suffering from strokes, reduced incidence of diabetes, etc. (see for example Wong and Radhakrishnan (Nutrition Reviews, 70(9), pp. 483-490 (2012)) Furthermore, it has been reported that tocotrienols have significantly more antioxidant power than tocopherols, and this has led to tocotrienols being described as "super vitamin E". These reputed medical and health benefits have generated considerable interest in tocotrienols in recent years and this has led to an increasing demand for products containing tocotrienol. However, despite vitamin E being found in a broad range of vegetable oils, tocotrienols are generally the minor vitamin E component in most vegetable oils.

Sources of vitamin E containing a higher proportion of tocotrienols include red palm oil, annatto oil, rice bran oil, and barley oil. By volume, red palm oil is produced in the largest quantities and has the potential to provide a large quantity of tocotrienols to the market as it is currently a relatively untapped resource.

In conventional vegetable oil processing, the oil is extracted from the vegetative matrix using an organic solvent and this co-extracts the minor compounds such as vitamins as well as the free fatty acids and glycerides. The oils are typically subjected to several pre-treatments such as solvent removal, de-gumming, deacidification (chemical or physical refining), deodourising, and bleaching to generate the glyceride oil product. Vegetable oil production processes are optimised to produce high yields of the refined glyceride oil and not the minor valuable components such as vitamin E. Some vitamin E can be recovered as condensate from distillate streams however, as vitamin E is thermally sensitive, much of the vitamin E is lost through thermal damage during processing steps such as physical refining, bleaching and deodorising. This is particularly the case for palm oil, where the natural red colour (due to carotenoids in the oil) is considered to be an undesirable impurity in oil produced for food and it is destroyed through a thermal bleaching process—the relatively harsh conditions of this thermal bleaching process also destroys much of the vitamin E (particularly the more unstable tocotrienols) present in the oil.

It can be understood by one skilled in the art that though the conventional oil refining techniques are practical and in widespread use, they present a number of limitations and problems to the user. This is particularly so for natural oils containing small quantities of high-value temperature-sensitive species, where there is a desire to selectively remove the high-value species (e.g. vitamin E and tocotrienols) while maintaining high yields of the natural oil.

A number of methods to address the problem of producing tocotrienols from natural oils have been described in the literature.

U.S. Pat. No. 5,157,132 describes a method for generating enriched tocotrienol product. The method first requires the transesterification of a glyceride oil to form fatty acid methyl esters and glycerol. Then the tocotrienols are enriched from the fatty acid methyl ester phase using conventional organic solvents in a sequence of steps involving liquid-liquid extraction, evaporation, precipitation, solid-liquid filtration, and adsorption.

U.S. Pat. No. 7,544,822 describes a method of generating an enriched tocopherols and totoctrienol product from vegetable and edible oils. '822 teaches that the oil should first be transesterified with a monohydric alcohol and then the resulting fatty acid methyl ester solution is subjected to a series of molecular distillation and crystallisation processes in order to generate an enriched and purified product. The process as claimed is complex and furthermore destroys the glyceride oil, which has some value in its own right.

U.S. Pat. No. 8,048,462 teaches the use of supercritical carbon dioxide and near-critical propane to generate enriched fractions of natural compounds through a combination of selective extraction of compounds from palm oil or palm oil derivatives and then using adsorption techniques with supercritical carbon dioxide and near-critical propane as the eluent to further purify the extracts.

U.S. Pat. No. 6,350,453 describes the generation of a tocotrienol enriched product from byproduct material formed when manufacturing annatto colorant from the plant *Bixa orellana*. The process is a distillation-based process utilising molecular distillation to separate the tocotrienol fraction from other components, such as geranylgenaniol.

Several other patents also describe processes based on adsorption, extraction and distillation to generate enriched tocotrienol compositions, these include U.S. Pat. No. 6,224,717, U.S. Pat. No. 7,507,847, WO 2010/125988, WO 2012/154613.

Another approach that has been reported in some literature is to apply membrane filtration to separate high value compounds from natural oils. For instance, Darnoko and Cheryan (JAOCS, 83(4), pp. 365-370 (2006)) evaluated three membranes for their ability to separate carotenoids from red palm methyl ester solution. Moderate rejection of carotenoids by the membranes were noted. No information relating to tocotrienols is disclosed. Othman et al (J. Mem. Sci., 348, pp. 287-297 (2010)) studied the removal of impurities generated during the production of biodiesel (methyl esters) from red palm oil. However, they did not assess the removal of tocotrienols. Othman et al (J. Applied Sciences, 10(12), pp. 1187-1191 (2010)) also published a short review of methods for extracting carotenoids and vitamin E from palm oil. The review briefly describes a number of aspects of the commercially used unit operations—solvent extraction, adsorption and transesterification/molecular distillation. Membrane technology is referenced in passing but not discussed. The review teaches that alkanes, i.e. hexane, and short-chain alcohols can be used to extract oil but that there are a number of disadvantages to using organic solvent, and supercritical fluids are also viable solvents but have a number of disadvantages due to the high working pressure. No direction is given to the reader for favoured solvents or processes.

U.S. Patent Application No. 2010/0130761 (WO 2008/002154) describes the use of membranes for deacidifying fish oil and other glyceride oils. This disclosure utilizes the fact that free fatty acids are more easily dissolved in immiscible alcohol solvents (e.g. ethanol) than triglycerides to produce an extract enriched in free fatty acids. In addition to the free fatty acids a portion of the triglyceride oil also dissolves in the alcohol solvent. A nanofiltration membrane is used to separate the free fatty acids from the triglyceride oil in the ethanolic extract to maximize recovered yield of the triglyceride oil. A low molecular weight cut-off polyimide membrane (molecular weight cut-off below 400 g·mol-1) is selected in this process to allow permeation of the free fatty acids but retain triglycerides. In WO '154 deacidifying of the crude fish oil is done via solvent extraction. Further work up of the residue of the extraction process is necessary to obtain the purified fish oil. Membrane filtration is only used for work up of the side product stream. Thus, this process is not very efficient and there remains a need for a more economical process to obtain highly purified phospholipid and triglyceride oils from crude oils. This work does not disclose any teachings regarding high-value compounds, such as vitamins and in particular tocopherols and tocotrienols.

Arora et al. (Desalination, 191, pp. 454-466 (2006)) describe an investigation of the potential to apply non-porous hydrophobic membranes in palm oil processing. They evaluate the potential to separate phospholipids, glycerides, free fatty acids, carotenes and antioxidants (i.e. tocopherols and tocotrienols) from crude palm oil. They comment that membranes have the potential to significantly reduce the loss of tocopherols and tocotrienols during palm oil processing, rather than the 45-85% losses observed in conventional refining processes. However, they conclude from their study that membranes are capable of effectively separating phospholipids from glycerides, but there is no significant selectivity for carotenes, tocopherols and tocotrienols versus glycerides in palm oil.

These studies, particularly Arora et al., would not motivate one skilled-in-the-art to apply a membrane-based solution to the separation of tocopherols and tocotrienols from palm oil.

There thus remains a need in the art for a more efficient process for removing vitamin E, specifically tocotrienols and tocopherols from a fatty acid oil mixture such as a triglyceride or phospholipid oil, in particular palm oil.

It is therefore an object of the present invention to provide a process to isolate vitamin E components from fatty acid oil mixtures without the disadvantages of the prior art processes respectively having less disadvantages compared to the processes disclosed in the prior art.

A special object of the present invention was to provide a process that allows increase in the tocotrienol to tocopherol ratio compared to the ratio in the crude oil mixture.

In another special object of the present invention the process should allow isolation of more than one product. For example it should be possible to isolate a purified fatty acid oil mixture as one product and a second product with increased vitamin E content.

In further special objects the process of the invention should be easy to handle, flexible in scale, energy efficient and economic.

Further objects not explicitly mentioned can be derived from the overall content of the description, examples, claims and figures of the present application.

Disclosed herein is therefore a process which may achieve the effect of extracting and concentrating tocopherols and tocotrienols from a vegetable fatty acid oil mixture. The disclosed process may simplify the treatment of a fatty acid oil mixture to generate a concentrated or enriched tocotrienol and tocopherols mixture, which may be further treated to isolate a specific mixture of tocopherols and tocotrienols or further concentrate the tocopherols and tocotrienols, while maintaining the yield and quality of the fatty acid oil mixture. In particular, the disclosed process may be used to generate an enriched vitamin E composition from vegetable oils such as rice bran oil, coconut oil, or soya oil. More preferably, the disclosed process may be used to generate an enriched tocopherols and tocotrienol composition from palm oil.

The present invention relates to a process for generating products, which compared to the initial fatty acid oil mixture and after removing of any solvent, are enriched in at least one vitamin E component, in particular of tocotrienol, comprising:

(a) mixing the fatty acid oil mixture with an immiscible organic solvent to form a heterogeneous, two-phase mixture;

(b) separating the two phases to form a first phase (oil phase) containing mainly the Vitamin E depleted fatty acid oil mixture, in particular the main part of the oil fraction, and a second phase comprising the organic solvent, vitamin E components and optionally one or more one impurity(s). Preferably the second phase contains mainly the solvent together with, preferably most of, the vitamin E components, and optionally impurities. Usually it cannot be avoided that free fatty acids and a little amount of the oils are co-extracted with the vitamin E components.

(c) passing the second phase obtained in (b) across at least one selective membrane, wherein a retentate forms comprising the desired vitamin E components from the second phase and optionally a portion of the fatty acid oil mixture that has dissolved in the solvent, and a permeate forms comprising the solvent and any component that is not retained by the membrane, in particular impurities and free fatty acids (d) removing the organic solvent from the retentate obtained in (c) to provide as product 1 a composition enriched in vitamin E compared to the crude oil. The concentration of at least one compound from the tocopherols/tocotrienols group, preferably a tocotrienol, in the vitamin E-enriched composition has an increased concentration compared to the original fatty acid oil mixture, and (e) optionally recovering the organic solvent from the permeate obtained in step (c) to form as product 3 an impurity composition. Preferably the solvent can be recycled and reused, especially preferred in process step (a), and (f) optionally removing any solvent from the first phase (oil phase) obtained in step (b) to obtain as product 2 a fatty acid oil mixture depleted in vitamin E components compared to the raw material, preferably that is substantially composed of the glyceride content of the initial fatty acid oil mixture. The recovered organic solvent is preferably reused, especially preferred in step (a), wherein the fatty acid oil mixture comprises triglyceride oils, phospholipid oils, and any combination thereof and wherein the membrane used in step (c) is characterized by a rejection $R_{Vit}$ of the target vitamin E components tocopherols and tocotrienol, preferably the tocotrienol compounds, that is greater than the membrane rejection of the impurities $R_{Imp}$ that permeate through the membrane. Thus, the major amounts of tocopherols and tocotrienol are extracted from the fatty acid oil mixture and are retained by the membrane.

Preferred organic solvent used in step (a) will be described later on. Particular preferred organic solvents, however, are selected from primary alcohols, such as methanol or ethanol, or iso-propanol and solvent mixtures containing primary alcohols where the non-alcohol solvent(s) may include a further organic solvent, a liquefied gas or a supercritical gas. Preferred extraction conditions are described later-on, too. Particular preferred, however, the extraction is carried out in the temperature range 30-80° C. and at a pressure of (i) 1-10 atm absolute when organic solvents are used, (ii) 1-80 atm absolute when a solvent system containing liquefied gases are used, and (iii) 1-400 atm absolute when a solvent system containing supercritical gases as used.

Details on the membranes used in step (c) will be provided below. Particular preferred, however, are selective membranes having a molecular weight cut-off in the range from about 200 g·mol-1 to about 800 g·mol-1 and the filtration is carried out at a trans-membrane pressure in the range 5 to 70 bar and at a temperature in the range 20 to 70° C.

In step (d) one or more thermal processing techniques such as distillation, preferably at reduced pressure to maintain lower distillation temperature, or evaporation optionally combined with a membrane separation process such as organic solvent nanofiltration, membrane distillation or vapour permeation is preferably used to provide the solvent removal, In optional steps (e) and (f) the solvent is preferably removed using a thermal separation technique such as distillation or evaporation, a membrane-based separation such as organic solvent nanofiltration, or a combination of membrane and thermal separation techniques and the recovered organic solvent can be recycled and reused in solvent extraction process (a)

The present invention further relates to a process for making a concentrate comprising at least one vitamin E component (i.e. tocopherol or tocotrienol compound) from a fatty acid oil mixture comprising process steps (a) to (d) and optionally (e) and/or (f) as described above. It is to be understood that both the foregoing general description and the following detailed description are exemplary and explanatory only and are not restrictive of the disclosure, as claimed.

DESCRIPTION

Figure 1:
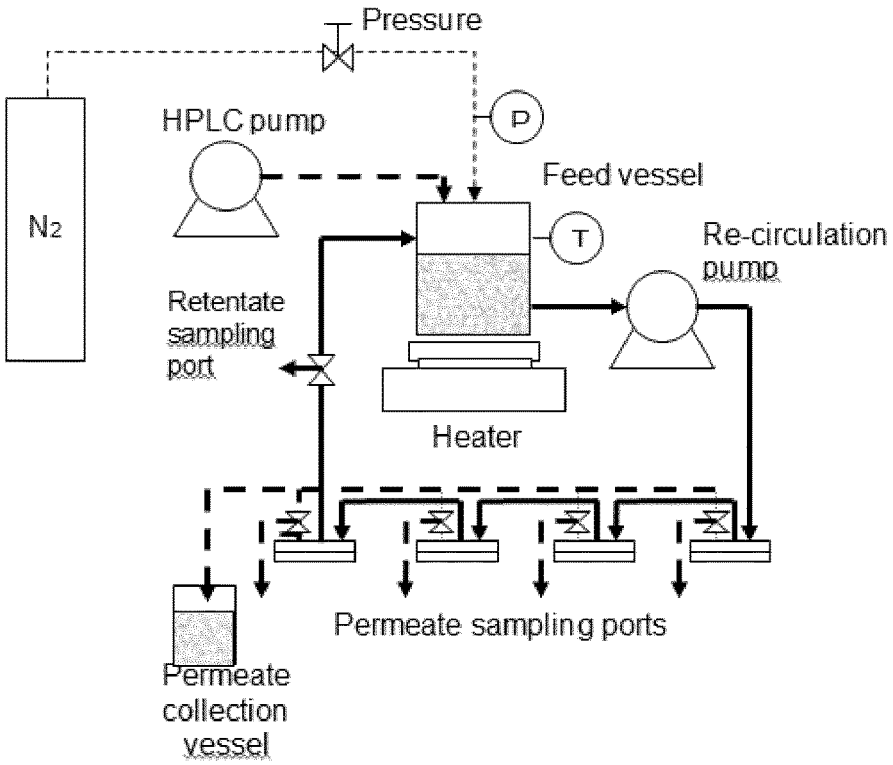
FIG. 1: A schematic of the cross-flow nanofiltration system as described in the examples.

Particular aspects of the invention are described in greater detail below. The terms and definitions as used in the present application and as clarified herein are intended to represent the meaning within the present disclosure. The patent and scientific literature referred to herein and referenced above is hereby incorporated by reference. The terms and definitions provided herein control, if in conflict with terms and/or definitions incorporated by reference.

The singular forms "a," "an," and "the" include plural reference unless the context dictates otherwise. "%" means "% by weight" unless the context dictates otherwise. The terms "approximately" and "about" mean to be nearly the same as a referenced number or value. As used herein, the terms "approximately" and "about" should be generally understood to encompass ±30% of a specified amount, frequency or value.

As used herein the term "acid value" of a fat or an oil means the amount of free acids present in a fat or an oil equal to the number of milligrams of potassium hydroxide needed to neutralize one gram of the oil, i.e. that the term serves as an index of the efficiency of refining. This means that a high acid value is characteristic for low quality oil or fat products.

The term "fatty acid(s)" includes, e.g., short-chain and long-chain saturated and unsaturated (e.g., monounsaturated and polyunsaturated) hydrocarbons comprising one carboxylic acid group.

The term "free fatty acid(s)" means "fatty acid(s)" (as defined above) that are naturally found in oil and are not incorporated into a glyceride or phospholipid molecule. The term "fatty acid oil(s)" includes oils from all types of sources originating from both marine and non-marine environments comprising triglyceride oils, phospholipid oils or mixture thereof. "Non-marine originating" means that the oil was obtained from species neither living nor growing in an ocean, respectively salt water. "Marine oils" respectively "marine originating oil", both terms are used analogously in the present invention, are derived from species, for examples animals or plants living in the sea or in salt water.

The terms "vitamin E" and "tocochromanol" are used synonymously in the present invention. Usually "vitamin E" is used in animal and human cells for tocopherols and tocotrienols that have a vitamin E function. In plant material tocopherols and tocotrienols do not have vitamin E function even though they have identical chemical structure compared to tocopherols and tocotrienols in human and animal cells. Thus, usually the term "tocochromanol" is used in plant material and includes al tocopherols and tocotrienols occurring in the plant material. Within the present invention the terms "vitamin E" and "tochochromalols" include all tocopherols and tocotrienols occurring in human, animal or plant cells, in particular all eight of the natural compounds described as tocopherols or tocotrienols, i.e. α-, β-, γ-, and δ-tocopherol and α-, β-, γ-, and δ-tocotrienol.

The terms "natural compound" or "natural components" are used in the present invention to define non-synthetic compounds present in the fatty acid oil. Some of these natural compounds may be used for human or animal nutrition or for other purposes. Not covered by the term "natural compound" or "natural components" are glyceride oil, phospholipid oils and fatty acids.

The terms "enriched" or "with increased content" mean that the concentration of a component in a phase after a separation step, i.e. extraction in step (a) or membrane separation in step (c) or after both separation steps, is higher than in the initial phase before separation took place. To determine whether the concentration is "enriched" organic solvents have to be removed from the initial phase and also from the separated phase to eliminate solvent dilution effects. For example the tocotrienol content in the crude oil is compare with its content in product 1 after removal of the solvents used for extraction and membrane separation.

Fatty Acid Oil Mixture

A fatty acid oil mixture such as a triglyceride or phospholipid oil according to the present invention are oil(s), including animal and/or non-animal oil(s) or oils derived thereof from any of these oils. In some embodiments of the present invention, the fatty acid oil mixture comprises at least one oil chosen from animal fat or oil, single cell oils, algae oil, plant-based oil, microbial oil, and combinations thereof.

Plant-based oils include, for example, flaxseed oil, canola oil, mustard seed oil, corn oil, palm oil and soybean oil. Single cell/microbial oils include, for example, products by Martek, Nutrinova, and Nagase & Co. Single cell oils are often defined as oils derived from microbial cells and which are destined for human consumption. See, e.g., Wynn and Ratledge, "Microbial oils: production, processing and markets for specialty long-chain omega-3 polyunsatutrated fatty acids," pp. 43-76 in Breivik (Ed.), Long-Chain Omega-3 Specialty Oils, The Oily Press, P.J. Barnes & Associates, Bridgewater UK, 2007.

In a preferred embodiment, the fatty acid oil mixture used in the present invention comprises at least one vegetable oil. Vegetable oils include triglyceride vegetable oils, commonly known as long chain triglycerides, such as castor oil, corn oil, cottonseed oil, olive oil, peanut oil, rice bran oil, safflower oil, sunflower oil, sesame oil, soybean oil, hydrogenated soybean oil, and hydrogenated vegetable oils; and medium chain triglycerides such as those derived from coconut oil or palm seed oil. In addition, some speciality vegetable oils can be produced from grain or seeds from a wide range of plants. Such oils include wheat oil, pumpkin seed oil, linseed oil, grape seed oil, blackberry seed oil, annatto oil, nut oils, and various other oils. In particular preferred embodiments, the fatty acid mixture comprises a vegetable oil chosen from palm oil, soybean oil, rapeseed oil, sunflower oil, peanut oil, cottonseed oil, palm kernel oil, coconut oil, olive oil, corn oil, grape seed oil, hazelnut oil, linseed oil, rice bran oil, safflower oil, sesame oil, almond oil, pecan oil, pistachio oil, walnut oil, castor oil, and jojoba oil, most preferred from palm oil. Furthermore the oil may be a phospholipid oil or contain phospholipid(s). Phospholipids, often found in substances known as "lecithin(s)" include compounds such as phosphatidylcholine, phosphatidylethanolamine, and phosphatidylinositol. sources of phospholipids include soy beans, sunflower and egg yolk.

In other embodiments of the present disclosure, the fatty acid oil mixture comprises at least one animal fat or oil, such as milk or butter fat, or fat-containing tissue or organs from animals such as, for instance, cattle, pig, sheep, or poultry. A non-limiting example of oil includes oils from algae.

In further embodiments of the present disclosure, the fatty acid oil mixture comprises oil originating from originating bacteria or yeasts (such as, for example, from a fermentation process).

The fatty acid oil mixture used in the present invention preferably comprises triglyceride oils and/or phospholipid oils, or any combination thereof. Further, the fatty acid oil mixture may comprise greater than 20%, preferably greater than 30%, particular preferred greater than 40%, very particular preferred greater than 60%, especially preferred greater than 60%, triglycerides and/or phospholipid oils. The upper limit of the triglyceride and/or phospholipid oil content is preferably above 95%, particular preferred above 90% and very particular preferred above 80%. In very special embodiments the fatty acid oil mixture already comprises more than 80% and most preferred more than 90% triglycerides and/or phospholipid oils.

The triglyceride oils may contain free fatty acids, as well as mono- and diglycerides from hydrolysis of the triglycerides. Mono-glycerides are considered to be impurities in the present invention.

The preferred raw material comprises as main components tocotrienol/tocopherols and di- and triglycerides and/or phospholipids, depending on the crude oil.

In some embodiments, the fatty acid oil mixture may have an acid value of greater than or equal to 10 mg KOH/g. For example, in at least one embodiment, the acid value of the fatty acid oil mixture ranges from 10 to 25 mg KOH/g. In other embodiments, the fatty acid oil mixture may have an acid value ranging from 0 to 25 mg KOH/g.

The process of the invention is particularly suited to producing compositions enriched in vitamin E, especially the tocotrienol content of vitamin E, via a process embodying both extraction and membrane separation processes. The process embodied in this invention is much simpler and more efficient than the processes known so far.

Membrane

Suitable selective membranes for use according to the present disclosure include polymeric and ceramic membranes, and mixed polymeric/inorganic membranes. Membrane rejection, Ri, is a term of art defined as:

$$R_i = \left(1 - \frac{C_{Pi}}{C_{Ri}}\right) \times 100\% \quad (1)$$

wherein CP,i=concentration of species i in the permeate, "permeate" being the liquid which has passed through the membrane, and CR,i=concentration of species i in the retentate, "retentate" being the liquid which has not passed through the membrane. It will be appreciated that a membrane is suitable for the process disclosed herein if R(Vit)>R(Impurities). Since the vitamin E components tocotrienol/tocopherols are the target compounds (Vit), R(Vit) must be greater than R(Impurities).

The at least one selective membrane according to the present disclosure may be formed from any polymeric or ceramic material which provides a separating layer capable of separating the desired tocotrienol/tocopherols content from at least one natural impurity present in the fatty acid oil mixture. For example, the at least one selective membrane may be formed from or comprise a material chosen from polymeric materials suitable for fabricating microfiltration, ultrafiltration, nanofiltration, or reverse osmosis membranes, including polyethylene, polypropylene, polytetrafluoroethylene (PTFE), polyvinylidene difluoride (PVDF), polysulfone, polyethersulfone, polyacrylonitrile, polyamide, polyimide, polyamideimide, polyetherimide, cellulose acetate, polyaniline, polypyrrole, polyetheretherketone (PEEK), polybenzimidazole, and mixtures thereof. The at least one selective membrane can be made by any technique known to the art, including sintering, stretching, track etching, template leaching, interfacial polymerization, or phase inversion. In at least one embodiment, the at least one selective membrane may be crosslinked or treated so as to improve its stability in the process solvents. For example, non-limiting mention may be made of the membranes described in GB2437519, the contents of which are incorporated herein by reference.

In at least one embodiment, the at least one selective membrane is a composite material comprising a support and a thin, non-porous, selectively permeable layer. The thin, non-porous, selectively permeable layer may, for example, be formed from or comprise a material chosen from modified polysiloxane based elastomers including polydimethylsiloxane (PDMS) based elastomers, ethylene-propylene diene (EPDM) based elastomers, polynorbornene based elastomers, polyoctenamer based elastomers, polyurethane based elastomers, butadiene and nitrile butadiene rubber based elastomers, natural rubber, butyl rubber based elastomers, polychloroprene (Neoprene) based elastomers, epichlorohydrin elastomers, polyacrylate elastomers, polyethylene, polypropylene, polytetrafluoroethylene (PTFE), polyvinylidene difluoride (PVDF) based elastomers, polyetherblock amides (PEBAX), polyurethane elastomers, crosslinked polyether, polyamide, polyaniline, polypyrrole, and mixtures thereof.

In another embodiment, the at least one selective membrane is prepared from an inorganic material such as, for example, silicon carbide, silicon oxide, zirconium oxide, titanium oxide, and zeolites, using any technique known to those skilled in the art such as sintering, leaching, or sol-gel processing.

In a further embodiment, the at least one selective membrane comprises a polymer membrane with dispersed organic or inorganic matrices in the form of powdered solids present at amounts up to 20 wt % of the polymer membrane. Carbon molecular sieve matrices can be prepared by pyrolysis of any suitable material as described in U.S. Pat. No. 6,585,802. Zeolites as described in U.S. Pat. No. 6,755,900 may also be used as an inorganic matrix. Metal oxides, for example, titanium dioxide, zinc oxide, and silicon dioxide may be used, such as the materials available from Evonik Industries AG (Germany) under their AEROSIL and ADNANO trademarks. Mixed metal oxides such as mixtures of cerium, zirconium, and magnesium oxides may also be used. In at least one embodiment, the matrices will be particles less than about 1.0 micron in diameter, for example less than about 0.1 microns in diameter, such as less than about 0.01 microns in diameter.

In at least one embodiment, the at least one selective membrane comprises two membranes. In another embodiment, the at least one selective membrane comprises three membranes.

The at least one selective membrane used in step (c) and optionally in other steps of the present invention comprises a nanofiltration membrane. As used herein, the term "nanofiltration" means membrane filtration which separates molecules having molar masses ranging from about 150 to about 1,500 Da. In at least one embodiment, the trans-membrane pressure used for filtration ranges from about 0.3 MPa to about 7 MPa, preferably about 0.5 MPa to about 7 MPa.

In at least one embodiment, the at least one selective membrane has a molecular weight cut-off ranging from about 150 g/mol to about 1,500 g/mol. For the purposes of this application, molecular weight cut-off is defined according to the methodology of See-Toh et al (2007) (Journal of Membrane Science, 291 (1-2), pp. 120-125), where the molecular weight cut-off is taken to be the molecular weight at which 90% rejection is achieved of a series of styrene oligomers. In a preferred embodiment, the at least one selective membrane has a molecular weight cut-off ranging from about 200 g/mol to about 800 g/mol, particular preferred from about 200 g/mol to about 700 g/mol and a very particularly preferred molecular weight cut-off from about 300 g/mol to about 600 g/mol.

Particularly good results have been found in the process of the present invention if the selective membrane is a hydrophobic membrane. For the purposes of this application, "Hydrophobic" means that the selective membrane should provide a contact angle for water of more than 70° at 25° C., as measured using the static sessile drop method described in ASTM D7334. Preferred selective membranes have a contact angle for water of more than 75° at 25° C. Especially preferred are selective membranes having a contact angle for water of more than 90° at 25° C. and most preferred of more than 95° at 25° C.

Particularly preferred hydrophobic membranes of the present invention are polyimide membranes, particularly preferred made of P84 (CAS No. 9046-51-9) and P84HT (CAS No. 134119-41-8) and/or mixtures thereof. The polyimide membranes optionally may be crosslinked according to GB 2437519. To avoid lengthy text repetitions the content of GB 2437519 is herewith incorporated by reference to the description of present application as a whole. Also particular preferred in the present invention are organic coated polyimide membranes, particularly preferred made of above mentioned crosslinked or non-crosslinked P84 and/or P84HT membranes. Very good results have been achieved with crosslinked or non-crosslinked, coated polyimide membranes, especially made of P84 and/P84HT and/or mixtures thereof, wherein the coating comprises silicone acrylates.

Particular preferred silicone acrylates to coat the membranes are described in U.S. Pat. No. 6,368,382, U.S. Pat. No. 5,733,663, JP 62-136212, P 59-225705, DE 102009047351 and in EP 1741481 A1. To avoid lengthy repetitions the contents of both patent applications are incorporated by reference to the present application. They are part of the description and in particular of the claims of the present invention. In particular preferred in the present invention is the combination of the especially preferred polyimides mentioned above with the silicone acrylates claimed in DE 102009047351 and in EP 1741481 A1. These combinations are part of the claim of the present invention.

Impurities

The process of the present invention is used to generate as product 1 a composition enriched in vitamin E, particularly tocotrienols, from a fatty acid oil mixture. In addition to the di- and tri-glyceride and phospholipid and vitamin E content, the fatty acid oil mixture contains a number of other compounds, for example lower molecular weight or with smaller molecular dimensions. The term "impurities" includes, but is not limited to, for example, undesirable natural and unnatural components present in the crude oil. "Undesirable" means impurities that are not wanted in the target vitamin E, especially tocotrienol, enriched product. Non-limiting examples include colourants or free fatty acids or compounds causing bad taste or bad smell, etc. "Impurities", however, may also comprise natural and unnatural components present in the crude oil which are unsuited for human consumption or animal feed, i.e. which are for example harmful or cause bad taste or bad smell, etc. In particular impurities are compounds having a regulatory limit for human consumption, for example because they would bioaccumulate and could provide toxic, mutagenic, carcinogenic, etc. effects over time.

Explicitly not regarded as impurities in the present invention are di- and triglycerides and phospholipids.

Application of the process of the invention, will result in a fatty acid oil mixture containing reduced concentrations of impurities and a reduced content of vitamin E which can be isolated as product 2, a composition enriched in vitamin E, especially, tocotrienol content which is isolated as product 1, and a composition containing impurities removed from the fatty acid oil mixture and the tocotrienolrich composition which can be isolated as product 3. In certain cases, application of the process will provide a product 2 containing impurity levels within desired and/or regulatory limits for, for instance, human consumption.

The concentration and composition of the impurities found in the initial fatty acid oil mixture can vary. For example, it may vary based on geography, species, etc. In some instances, the impurities may be absent or below the detection limit, but by way of applying the disclosed process invention the impurities may also be concentrated. Additionally, the methods (e.g., the analytical methods) used to determine the level or concentration of the impurities found in the initial fatty acid oil mixture as well as any one of products 1 to 3 vary with regard to the limit of detection and limit of quantification. Although established methods, i.e. validated methods, may be available for some of the impurities, they may not be for others.

Further non-limiting examples of impurities are free and/or esterified cholesterol, free fatty acids, colored components, oxidation products, phytosterols, other sterols, lipophilic hormones, monoglycerides, astaxanthin, canthaxanthin, other carotenoids, xanthophylls, and components that create unwanted smell and taste in the oil, such as aldehydes and/or ketones. In at least one embodiment, the removal of coloured components results in products having improved color, and removal of components that create unwanted smell and taste result in a fatty acid oil mixture having an improved taste profile.

One important class of impurities is environmental pollutants. Oils from polluted areas may contain, for example, high levels of environmental pollutants that make the free fatty acid oil mixture unsuited for human consumption or animal feed. The process of the invention may remove environmental pollutants, thereby producing products suitable for human consumption or use as animal and/or fish feed from highly polluted oils.

Process for Producing Tocotrienol-Enriched Compositions and Process for Reducing at Least One Impurity from a Fatty Acid Oil Mixture Some embodiments of the present invention relate to a process for making a composition enriched in at least one vitamin E component, preferably in tocotrienol, from a fatty acid oil mixture as defined above using a solvent extraction process followed by at least one membrane separation step. Additionally, some embodiments of the present disclosure relate to a process for reducing impurities from said fatty acid oil mixture using a solvent extraction process and at least one selective membrane.

In step (a) of the process of the invention, the initial fatty acid oil mixture is mixed with an organic solvent to form a two-phase mixture in one or more liquid-liquid extraction equilibrium stages. Mixing of the two phases may be achieved by any technique known to one skilled in the art, such as, for example, via static inline mixer, dynamic inline mixer, and/or mixing vessel containing a mechanical stirrer. Separation of the two phases may be achieved by any technique known to one in the art such as, for example, gravity separation, centrifugation and/or coalescence. Furthermore the mixing and settling of the two phases maybe achieved in a dedicated solvent extraction unit such as, for example, a centrifugal contactor system, a packed column system, a pulsed column system, a bucket contactor system, or any other means know to one skilled in the art.

The term "organic solvent" includes, for example, an organic liquid with molecular weight less than 300 Daltons. The term "solvent" includes a mixture of organic solvents, as well as a mixture of organic solvents and water, which might be useful as a minor component in the solvent mixture.

By way of non-limiting example, organic solvents include aromatics, alkanes, ketones, glycols, chlorinated solvents, esters, ethers, amines, nitriles, aldehydes, alcohols, phenols, amides, carboxylic acids, furans, CO2 and dipolar aprotic solvents, and mixtures thereof and with water, which might be useful as a minor component in the solvent mixture.

Preferably organic solvents used in the present invention are those approved for food-grade applications, especially according to Annex I of Directive 2009/32/EC of the European Parliament and of the European Council of Apr. 23, 2009, most preferred are food-grade solvents selected from the list comprising propane, butane, ethyl acetate, ethanol, carbon dioxide, acetone, nitrous oxide, hexane, methyl acetate, ethyl methylketone, dichloromethane, methanol, propan-2-ol, diethyl ether, hexane, cyclohexane, butan-1-ol, butan-2-ol, and 1,1,1,2-tetrafluoroethane and mixtures thereof and as mixture with water, which might be useful as a minor component in the solvent mixture.

By way of non-limiting example, when extracting non-polar fatty acid oil mixtures, for example triglyceride oils, preferred organic solvents to form a two-phase mixture will comprise ethanol, methanol, propan-2-ol, butan-1-ol, butan-2-ol, and mixtures thereof and with other organic solvents and optionally with water, which might be useful as a minor component in the solvent mixture.

By way of non-limiting example, when extracting polar fatty acid oil mixtures, for example phospholipid oils, preferred organic solvents to form a two-phase mixture will comprise propane, butane, ethyl acetate, acetone, hexane, methyl acetate, ethyl methylketone, dichloromethane, diethyl ether, hexane, cyclohexane, 1,1,1,2-tetrafluoroethane, and mixtures thereof and with other organic solvents and optionally with water, which might be useful as a minor component in the solvent mixture.

It will be understood by one skilled-in-the-art that (i) both the chemical nature of the components and the relative amount of components (e.g. free fatty acids, triglycerides, phospholipids, etc.) of the fatty acid oil mixture will determine the selection of preferred organic solvent(s) or organic solvent mixture(s) to maintain a two-phase mixture and provide extraction of the vitamin E components, especially of the tocotrienol compounds, and (ii) that these preferred solvent(s) and mixture(s) may not be predicted from theoretical considerations alone.

Very good results have been achieved when the solvent is selected from alcohols. Particularly preferred solvents are selected from methanol, ethanol, 1-propanol and 2-propanol. Very particular preferred solvents are selected from methanol and ethanol.

The term "organic solvent" may also include liquefied or supercritical gases, such as propane, butane or carbon dioxide, and mixtures of liquefied or supercritical gases and organic liquids (for example methanol or ethanol).

It will be understood by one skilled in the art that the extraction process can be carried out at a broad range of conditions, depending on the solvent used. By way of non-limiting example, operating pressures for the extraction process may be in the range 1 atm abs to 50 atm abs, preferably in the range 1 atm abs to 20 atm abs, particular preferred 1 atm to 10 atm, and most preferably in the range 1 atm abs to 5 atm abs, when organic liquid solvents are used When liquefied or supercritical gases are used operating pressures for the extraction process may by way of non-limiting example be in the range 1 atm abs to 1000 atm abs, preferably in the range 5 atm abs to 600 atm abs, and most preferably in the range 5 atm abs to 400 atm abs. It will be further understood by one skilled in the art that the operating temperature for the extraction process by way of non-limiting example can be in the range −20° C. to 200° C., preferably in the range 0° C. to 150° C., particular preferred in the range 20° C. to 100° C. and most preferable in the range 30° C. to 80° C.

It will be further understood by one skilled in the art that by applying the solvent extraction process two phases are generated. The first phase is comprised mainly of the fatty acid oil mixture and is depleted in vitamin E and optionally depleted in at least one impurity relative to the initial fatty acid oil mixture fed into the extraction system. The second phase contains predominantly the extraction solvent, vitamin E, the optionally at least one impurity, and the quantity of fatty acid oil mixture that saturates the extraction solvent composition.

The di-/tri-glyceride and phospholipid composition of the fatty acid oil mixture in the first phase is essentially the same as the initial feed fatty acid oil mixture, thus maintaining the natural ratio of the different fatty acids in the fatty acid oil mixture. In some embodiments of the invention, this first phase will become a product 2 in its own right once any extraction solvent dissolved in the fatty acid oil mixture has been evaporated. In further embodiments of the invention, the first phase will be further processed in additional unit operations known to those skilled in the art, by way of non-limiting example these operations may include winterisation, urea precipitation, distillation (including fractional and molecular distillation), adsorption, extraction, thermal heating, and reaction (including hydrogenation processes).

As indicated below, the second phase is subjected to membrane filtration to separate the vitamin E components from impurities co-extracted during step (a). Usually the second phase is subjected to membrane filtration without further purification steps in-between. In a special but also preferred alternative the process of the invention, however, comprises a step of cooling down the extract, i.e. second phase, before subjecting the phase to membrane filtration in step (c). This causes that free fatty acids comprised in the second phase precipitate and can be separated easily be filtration.

Optionally, additives that complex with fatty acids such as urea may be added to the solution to enhance precipitation. In this alternative an additional process step has to be accepted, however, in complicated cases the additional step might help to significantly improve the quality of product 1.

Separation of the vitamin E components from impurities, may be achieved through passing the vitamin E-rich extract solution (second phase as mentioned above) across at least one selective membrane that retains the vitamin E content, i.e. in the form of a retentate, and allows permeation of the impurities as well as the fatty acids, i.e. in the form of a permeate. A driving force, e.g. an applied pressure, is used to permeate content through the membrane. In at least one embodiment, the applied pressure ranges from 1 to 100 bar. For example, the applied pressure may range from 5 to 70 bar, such as from 15 to 60 bar.

As indicated before, the method of the invention can be used to make as a product 1 a concentrate comprising at least on vitamin E component, in particular to increase the tocotrienol content of vitamin E from a fatty acid oil mixture using the disclosed extraction process and selective membranes, resulting in the formation of a composition enriched in at least one vitamin E component, in particular tocotrienols, relative to the initial fatty acid oil mixture.

The process of the invention allows the isolation of most of the vitamin E components from the initial fatty acid oil. The inventors, however, surprisingly found out, that it is also possible, if desired, to obtain a product 1 which has a different composition of the vitamin E components compared to the initial fatty acid oil. They found out, that use of specific organic solvent or mixture of organic solvents, in step (a), enables to selectively extract tocotrienols and to obtain a product 1 with a higher tocotrienol to tocopherol ratio than in the initial fatty acid oil mixture.

In a special and preferred embodiment, the process of the invention therefore comprises a solvent selection step for a suitable solvent and a solvent screening step, wherein different organic solvents and preferably also different mixing ratios of organic solvent to fatty acid oil mixture are tested. To be suitable for selective "extraction", the organic solvent must form a two-phase mixture after contact with the fatty acid oil mixture. The term "organic solvent" in this special embodiment is defined analogue to the general definition given above, i.e. includes also mixtures of organic solvents and mixtures of organic solvents and water.

The solvent screening comprises for each tested organic solvent or solvent mixture the following steps:

Extraction of a sample of the fatty acid oil mixture with an organic solvent or solvent mixture to obtain a bottom fraction and an extract fraction. It is preferred that the tested sample is identical to the fatty acid oil mixture used as raw material for step (a) of the process of the invention.

Measuring the concentration of at least one tocopherol and at least one tocotrienol in the bottom fraction as well as in the extract fraction. As demonstrated in Example 2 below, there are usually different types of tocotrienols and tocopherols comprised in the crude oil mixture. Even if there is more than one type of tocotrienol and/or tocopherol in the crude oil mixture, it is usually sufficient, in order to reduce effort, to analyse the concentration of one type of tocotrienol and one type of tocopherol. The screening results are, however, more characteristic, if the concentrations of all types of tocotrienol and one type of tocopherol are measured, which is therefore preferred.

In the next step partition coefficients PC for at least one tocotrienol and at least one tocopherol comprised in the fatty acid oil mixture, preferably for all kinds of tocotrienols and tocopherols for which the concentrations have been measured in the step before, are calculated. PC is defined as ratio of the concentration of a tocotrienol or tocopherol in the extract fraction to the concentration of the same tocotrienol or tocopherol in the bottom fraction. As explained above it is sufficient to calculate one PC for one type of tocotrienol and one type of tocopherol, preferably, however, PC's for more types comprised in the raw material are calculated. Especially preferred calculations are done for all types.

In the solvent selection step, a solvent is selected for step (a) which has a $PC_{Tocotrienol}$ that is higher than the $PC_{Tocopherol}$ for at least one mixing ratio of organic solvent to fatty acid oil mixture applied during extraction. As shown in Example 2 below, the PC's of tocotrienol and tocopherol depend on the solvent but also on the ratio of solvent to fatty acid oil mixture chosen for extraction. Therefore it might come up, that a solvent has a higher $PC_{Tocotrienol}$ than $PC_{Tocopherol}$ only for a specific ratio or a specific range of ratios of solvent to fatty acid oil mixture. In that case it is preferred to use such a solvent in a solvent/oil ratio at which $PC_{Tocotrienol}$ is higher than $PC_{Tocopherol}$ in step (a) of the process of the invention.

If $PC_{Tocotrienol}$ and $PC_{Tocopherol}$ are already known or obtainable differently, this is also comprised in this special embodiment of the present invention. It is only necessary that the PC's are known to select a solvent for step (a).

It is thus especially preferred in this special embodiment to use an organic solvent or a mixture of organic solvents whose ratio of $PC_{Tocotrienol}$ to $PC_{Tocopherol}$ is in the range of from >1 to about 1000, preferably of from 1.05 to 500, more preferred of from 1.1 to 100, even more preferred 1.5 to 100 and most preferred of from 2 to 50. Particular preferred organic solvents or solvent mixtures to obtain product 1 with very high tocotrienol and lower tocopherol content comprise for non-polar lipids primary alcohols, particularly methanol and for polar lipids comprise alkanes or solvents with similar polarity.

In step (c), the second phase containing the extraction solvent is contacted with the first surface of the membrane, preferably by flowing the solution tangentially across the first surface. This preferred process is commonly known as "cross flow" filtration or "tangential flow" filtration. As a result, the vitamin E content is retained as the retentate, and that at least one impurity permeates through the at least one selective membrane to form permeate material. The present invention comprises embodiments, wherein the second phase containing the extraction solvent is contacted with at least one surface of more than one selective membrane, for instance, two or three selective membranes. In a special embodiment and non-limiting example, the second phase containing the extraction solvent may first be contacted with one surface of the first selective membrane to remove impurities that permeate through this first membrane, then the retentate comprising the second phase containing the extraction solvent content from the first selective membrane is contacted with a first surface of a second selective membrane to remove impurities that permeate through this second membrane. The selected first and second membranes may be the same, or the selected membranes may be different in order to effect permeation of different impurities with the different membranes. It will be understood by one skilled in the art that contacting the second phase containing the extraction solvent with three or more selective membranes may be necessary to provide the desired product.

In a further embodiment, the second phase containing the extraction solvent may be contacted with a first surface of a first selective membrane to generate a retentate comprising the vitamin E content and a permeate depleted in vitamin E. The permeate may contain sufficient concentration of vitamin E that the permeate solution from the first selective membrane is then contacted with the first surface of a second selective membrane to generate a further retentate comprising the vitamin E content and a permeate stream containing the at least one impurity. It will be clear to one skilled in the art that by processing the first permeate solution with a second membrane, the yield of the desirable vitamin E content will be increased. Furthermore, it will be clear to one skilled in the art that process configurations including both a series of selective membranes processing the second phase containing the extraction solvent and retentate comprising the vitamin E content and a series of selective membranes processing the permeate solution from any other selective membranes are feasible.

Thus, in at least one embodiment, the process disclosed herein further comprises optionally mixing the retentate with an organic solvent to form a retentate solution; passing the retentate solution across the at least one selective membrane, wherein a second retentate forms comprising vitamin E content, and a second permeate forms comprising at least one impurity; and removing the organic solvent from the second retentate to form a second composition enriched in vitamin E. In yet another embodiment, the process disclosed herein further comprises optionally mixing the permeate with an organic solvent to form a permeate solution; and passing the permeate solution across the at least one selective membrane, wherein a second retentate forms comprising vitamin E content, and a second permeate forms comprising at least one impurity.

In at least one embodiment, repetition of the process of mixing, passing, and removing may continue for a period of time ranging from about 10 minutes to about twenty hours. For example, in one embodiment, repeating the process of mixing, passing, and removing continues for a period of time ranging from about 30 minutes to about five hours. When tangential flow filtration (sometimes also referred to as crossflow filtration) is used to pass the solution across the surface of at least one selective membrane, the process may comprise a linear velocity at the membrane surface ranging from about 0.1 m/s to about 5 m/s, such as, for example, from about 0.5 m/s to about 3 m/s.

In the process disclosed herein, diafiltration is preferably used to enhance the enrichment of tocotrienol content in the vitamin E-rich extract composition. Diafiltration is known to those skilled in the art and is the process whereby fresh solvent is added to a solution undergoing filtration to enhance the quantity of lower molecular weight species that permeate through the membrane. Diafiltration is a liquid filtration process in which a feed liquid containing at least two solutes is in contact with a membrane and is pressurized so that some fraction of the liquid passes through the membrane, wherein at least one solute has a higher rejection on the membrane than at least one other solute. Additional liquid is fed to the pressurized side of the membrane to make up for the liquid permeating through the membrane. The ratios between the concentration of the more highly retained solute and the concentration of the less retained solute in the permeate and retentate varies dynamically, increasing in the retentate and decreasing in the permeate. Thus, in at least one embodiment, the passing of the solution across the at least one selective membrane comprises diafiltration.

A very particular preferred method for the present invention is a combination of cross-flow and diafiltration. Compared to other known processes like dead-end filtration, the preferred process of the present invention provides several advantages like: less fouling; less material loss, longer life time of the apparatus. In sum a higher efficiency can be achieved.

Optionally, any remaining solvent content in the vitamin E rich retentate is removed in step (d), resulting in the formation of a vitamin E rich composition as product 1. The vitamin E rich composition may then be optionally treated to generate compositions that are comprised of higher concentrations of vitamin E, and/or further enriched specifically in the tocotrienol fraction of the vitamin E. In some embodiments, additional solvent extraction steps may be carried out on the vitamin E rich composition to concentrate or isolate the vitamin E and specifically the tocotrienol compounds. Further techniques to treat the vitamin E rich composition includes at least one adsorption process comprising at least one absorbent or adsorbent to remove non-vitamin E components and/or remaining impurities. For instance, in at least one embodiment, the purified vitamin E is treated with activated carbon or another appropriate absorbent or adsorbent such as forms of silica, which, for example, may remove free fatty acid remaining in the product. In further embodiments, another appropriate absorbent or adsorbent such as modified silica may be used to selectively bind the vitamin E or specifically the tocotrienol content and thus afford a separation of the desired vitamin E/tocotrienol compounds from the other components in the composition. In yet further embodiments, distillation techniques may be used to further enrich or isolate the vitamin E and specifically the tocotrienols. By way of non-limiting example, such distillation techniques may include fractional distillation and molecular distillation. In yet further embodiments, liquid chromatographic techniques may be used to concentrate or isolate the vitamin E and specifically the tocotrienol compounds; these chromatographic techniques may include HPLC (high pressure liquid chromatography) or supercritical chromatography.

In step (e), solvent content in the permeate material containing at least one impurity is optionally recovered. The recovered solvent content may then be reused to in the solvent extraction in step (a). By way of non-limiting example, the solvent may be recovered by a thermal process such as flash evaporation or thin-film evaporation, or it may be recovered using a membrane filtration process where the at least one impurity is retained by the filtration membrane. In addition, in at least one embodiment, the permeate material is subjected to additional processing to recover desired components within the at least one impurity species. Subsequent recovery of the desired compounds as product 3 may be carried out by, for example, molecular distillation, short path evaporation, or chromatographic processes, such as HPLC (high pressure liquid chromatography) or supercritical chromatography, depending on the application.

Further, the crude fatty acid oil mixture may be pre-processed in one or several steps before constituting the starting material in the solvent extraction process as described above. An example of such a processing step is that the fatty acid oil mixture may be subject to washing with water and drying. The pre-processing steps of washing and drying may prevent the build-up of components in the system that can cause fouling on the membranes. As an alternative, caustic refining or acid washing may be used for the same purpose.

To perform the step of washing the fatty acid oil mixture with an aqueous phase (e.g. water, caustic or acid) and drying, for example, the fatty acid oil mixture may be mixed with the aqueous phase by a static mixer. Separation between the fatty acid oil mixture and aqueous phase may, for instance, be performed in a centrifuge or by gravimetric separation in a tank. Residual may then be removed, for example, under vacuum in a dryer.

It is known that in conventional vegetable oil refining (for example corn oil, soybean oil, sunflower oil and palm oil), the physical refining and deodourisation steps which are thermal separation (distillation) processes will generate a "waste" stream containing vitamin E. The process is effective in removing vitamin E from the fatty acid oil mixture, however the thermally sensitive nature of vitamin E (due to its antioxidant characteristics) means that a significant portion of the vitamin E is damaged during these thermal processing techniques. This is particularly true of the more valuable and more powerful antioxidant tocotrienol species, which may have very low yields from the typical thermal processing techniques used in vegetable oil refining. The yield of vitamin E and specifically tocotrienols will be significantly lower from the conventional thermal refining techniques for vegetable oils than can be achieved using the disclosed method. Temperatures in conventional vegetable oil refining processes can be in the range 170 to 250° C. or even higher. The process disclosed herein typically can be performed at temperatures ranging from 30 to 50° C., depending on the solubility of the fatty acid oil mixture in the solvent of choice, with excellent yield of vitamin E, specifically the tocotrienol content. In at least one embodiment, the process may be performed at a temperature ranging from about −10° C. to about 60° C., such as, for example, from about 25° C. to about 50° C.

The disclosed method can be used with triglyceride or phospholipid oils with practically any level of free fatty acids, as well as oils with high acid values, for example, oils with acid values ranging from about 0 to about 25 mg KOH/g, preferably about 0.2 to about 25 mg KOH/g.

Polyunsaturated fatty acids in particular are known to be vulnerable to thermal degradation. Compared to other known methods for generating vitamin E-rich solutions, the method disclosed herein may be performed effectively at "gentle" temperature conditions. The other known methods involve higher temperatures, which may be harmful to polyunsaturated fatty acids. By way of example, membrane filtrations may be carried out at near-ambient temperature in the range −10° C. to +60° C., which are considered to be "gentle" temperatures that minimize thermal damage on temperature-sensitive materials. Temperatures above 100° C., and for example, temperatures above 150° C., are considered "harmful" for omega-3 polyunsaturated fatty acids due to the rapid occurrence of oxidation and isomerization in the oil, leading to unwanted compounds that lower the quality of the oil. This means that by using the process of this invention, the fatty acid oil mixture product 2 from applying this process has essentially the same fatty acid composition as the fatty acid oil mixture fed into the process, which can be a significant advantage as it maintains the value and quality of the fatty acid oil mixture.

In addition, the method disclosed herein can be adapted to different requirements for the yield and/or content of individual tocopherol/tocotrienol species. For example, it is possible to select the extraction solvent to maximise the amount of vitamin E (i.e. both tocopherols and tocotrienols) extracted from the fatty acid oil mixture by selecting a solvent that provides high partition coefficient values for all the vitamin E compounds relative to other solvent systems. However, advantageously, it is also possible to select solvent(s) that show preferential partition coefficient values for one or more vitamin E compounds, such that those compound(s) with higher partition coefficient are selectively enriched in the solvent extract solution relative to the other vitamin E compounds. Thus, it will be understood by one skilled in the art that it is feasible to choose solvent systems depending on the target yield or selectivity of the process. Thus, the method disclosed herein is highly flexible: extraction yield and selectivity may be varied to deliver different product requirements as well as to process different starting fatty acid oil mixtures (which may comprise different concentrations of fatty acid oil content, glyceride and phospholipid content, impurities, and/or vitamin E content, for example).

An advantage of the process of the present invention can be seen in the fact that it is possible to isolate one or simultaneously two or three products whatever is desired.

Resulting Composition(s)

The present disclosure also relates to compositions resulting from the process disclosed herein. Such compositions may include the retentate, the purified oil, and/or the permeate material. The disclosure also relates to the purified oil (the oil phase resulting from the solvent extraction step of the disclosed process) after further processing, for example adsorption and distillation processes, forming a food- or feed-grade glyceride or phospholipid oil. In at least one other embodiment, the purified oil comprises palm oil. In at least one other embodiment, the disclosed process produces a food- or feed-grade glyceride or phospholipid oil with an at least 80% reduction in at least one impurity relative to the crude oil.

In yet another embodiment, the disclosed process produces a composition, such as the retentate from the membrane filtration process, comprising an increased concentration of vitamin E, phytosterols (from vegetable oils), cholesterol (from animal source oils), astaxanthin, canthaxanthin, natural colors, such as beta-carotene or other carotenoids, lipophilic hormones and xanthophyll, relative to the crude oil. In at least one further embodiment, the process produces a composition, such as the retentate, that is enriched in tocotrienols relative to the crude oil. In at least one further embodiment, the enriched tocotrienol composition, such as the retentate, may optionally be combined with for example an adsorption, extraction or distillation process to generate a composition containing at least 10 wt % tocotrienols. In yet a further at least one embodiment, the enriched tocotrienol composition may be further optionally processed with for example molecular distillation or chromatography to generate compositions containing particular combinations of tocotrienols with or without tocopherols, or to isolate specific tocotrienol compounds.

Reference Example 1: Single Stage Extraction

Extraction is a process for the separation of one or more components in a liquid solution through contact with a second immiscible liquid called a solvent. The separation will occur if the components in the original solution distribute themselves differently between the two phases.

Since the first step of the process of the present invention is an extraction step a screening of potential solvents is done in this reference example 1.

First methanol was tested for its efficiency in extracting of α-tocopherol and FFA from three vegetable oils. 200-300 ml of oil was mixed with the solvent using a magnetic stirrer at 35° C. The mixture is gravity separated and the oil stayed at the bottom. Partition coefficients of α-tocopherol and FFA were obtained by measuring the concentration of both compounds in the extract and the bottom fraction without evaporation of the solvent. The partition coefficient is calculated as follows: PC=(concentration in the extract)/(concentration in the bottom fraction). Table 1 summarizes the partition coefficient for the methanol extraction with three vegetable oils.

TABLE 1

Partition coefficient of FFA and α-tocopherol.

| | | Partition Coefficient | |
|---|---|---|---|
| | Solvent:Oil Ratio | Free Fatty Acids | α-tocopherol |
| Palm Oil | 2:1 | 0.85 | 0.15 |
| Rice Bran Oil | 2:1 | 0.40 | 0.20 |
| Rapeseed Oil | 3:1 | 0.34 | 0.39 |

Doing a mass balance on the Rapseed Oil example one has to multiply 0.39 with 3 (three times more solvent than in the oil fraction). Thus there is more tocopherol in the extract than in the oil fraction (1.17:1).

Methanol seems less efficient to extract α-tocopherol from palm oil. This can be justified due to the high content of glycerides and FFA when in comparison with the other two oils. Rapeseed oil have too close PC of FFA and α-tocopherol to provide a feasible extraction.

Ethanol is also a not miscible solvent with the oil but "attractive" to valuable compounds. Methanol and ethanol were tested for their efficiency in extracting both tocopherols and tocotrienols from palm oil in a solvent/oil ratio 3:1. Partition coefficients of tocopherols and tocotrienols were obtained by measuring the concentration of valuable compounds in the extract and the bottom fraction can be seen in table 2.

TABLE 2

Average partition coefficient of tocopherol and tocotrienol.

| Extraction Solvent | Average PC of TP and TT |
|---|---|
| Methanol | 0.30 |
| 99% Ethanol | 1.03 |
| 96% Ethanol | 0.94 |

Ethanol is more efficient as extraction solvent. 96% Ethanol was chosen for further investigation based on its ability to extract TT and TP and price/value Reference Example 2: Partition Coefficients of Tocopherols and Tocotrienols The solvent screening of reference example 1 was continued. In reference example 2, however, it was tested whether it is possible so selectively extract TT respectively TP, i.e. whether it is possible to selectively enrich only TT or TP.

Table 3 provides values of the individual partition coefficient values of tocopherol and tocotrienol compounds found in palm oil. The values were measured by contacting palm oil and ethanol (denoted PC Eth in Table 3) and palm oil and methanol (denoted PC Meth in Table 3) at the oil to solvent ratios noted in the table—e.g. PC Eth 1:5 means that one volume of palm oil was contacted with 5 volumes of ethanol. Table 3 shows that for a given solvent and oil to solvent ratio different partition coefficients are measured for the different tocopherol/tocotrienol compounds—indicating that species may be selectively extracted. Furthermore, it can be seen that on average the partition coefficient for ethanol extraction is higher than for methanol, indicating that for a given oil to solvent ratio it is possible to select solvents that will provide higher yield.

TABLE 3

Partition coefficient values of individual tocopherols and tocotrienols.

| Sample | Delta-tocopherol | Delta-tocotrienol | Alpa-tocopherol | Gamma-tocotrienol |
|---|---|---|---|---|
| PC Eth 1:1 | 0.50 | 1.13 | 0.30 | 0.72 |
| PC Eth 1:2 | 0.47 | 1.81 | 0.31 | 0.81 |
| PC Eth 1:3 | | 1.71 | 0.25 | 0.85 |
| PC Eth 1:5 | 0.53 | 2.04 | 0.42 | 0.79 |
| PC Eth 1:7 | 0.29 | 2.71 | 0.22 | 0.53 |
| PC Meth 1:1 | 0.25 | 2.33 | 0.21 | 1.17 |
| PC Meth 1:2 | 0.07 | 2.21 | 0.15 | 0.64 |
| PC Meth 1:3 | | 1.87 | 0.21 | 0.76 |
| PC Meth 1:5 | 0.09 | 0.93 | 0.11 | 0.46 |
| PC Meth 1:7 | 0.01 | 1.39 | 0.09 | 0.36 |

Reference Example 3: Multi Stage Extraction

To further evaluate how step (a) of the process of the present invention can be optimized, multi stage extraction was tested.

Multistage extraction can be arranged in a cocurrent, crosscurrent, or countercurrent manner. In cocurrent the first stage extract (solvent plus valuable compounds) is sequent sent to a fresh feed in the second stage. This methodology is then repeated until the desired removal. A cross-current multistage extraction fresh solvent is added at each stage for a single feed solution. The countercurrent arrangement normally gives the best compromise between high extract concentration and high degree of extraction of solute. The fresh solvent is added in counter current with the feed solution.

Methanol was used to extract TP, TT and FFA from palm oil. 200-300 ml of oil was mixed in a ratio 1:2 with the solvent using a magnetic stirrer at 35° C. The mixture is gravity separated and the oil stayed at the bottom. Partition coefficients of α-tocopherol and FFA were obtained by measuring the concentration of valuable compounds in the extract and the bottom fraction. Table 4 summarizes the partition coefficient for the methanol extraction with palm oil in four stages of cross-current and cocurrent.

TABLE 4

Partition coefficient of FFA and α-tocopherol.

| | Crosscurrent | | Cocurrent | |
|---|---|---|---|---|
| Extraction stage | Average PC of TP&TT | PC of FFA | Average PC of TP&TT | PC of FFA |
| 1st stage | 0.29 | 0.85 | 0.32 | 0.85 |
| 2nd stage | 0.29 | 0.75 | 0.17 | 0.83 |
| 3rd stage | 0.29 | 0.70 | 0.32 | 0.88 |
| 4th stage | 0.29 | 0.55 | 0.23 | 0.93 |

A mathematical simulation was created to assess the minimal stages necessary and which best combination of solvent usage and palm oil:solvent ratios to achieve high TP and TT enrichment. Table 5 summarizes the four best options using the experimental PC coefficient for FFA and TP/TT including the enrichment factor after the OSN process.

TABLE 5

Overall summary of combined extraction and membrane separation process.

| | Process | | | |
|---|---|---|---|---|
| | Crosscurrent | | Cocurrent | Counter-current |
| Number of stages | 4 | 3 | 4 | 4 |
| Oil:Solvent ratio | 1:1 1:1 1:1 1:3 | 1:1 1:2 1:3 | 1:2 | 1:3 |
| Extraction volume, L | 6.09 | 6.11 | 2 | 3 |
| TP and TT Yield, % | 74.0 | 73.0 | 80.7 | 92.2 |
| Enrichment factor, % | 15 | 12 | 12 | 9 |
| Total enrichment, % | 94 | 94 | 107 | 117 |

Using a multi stage process can provide high enrichment of TP and TT in the final product. Counter-current is the process with the best combination enrichment and solvent usage.

Inventive Example 1

Step (a) Extraction:

200-300 ml of palm oil was mixed with methanol using a magnetic stirrer at 35° C. The mixture is gravity separated and the oil stayed at the bottom. The extract was then removed and the valuable compounds extracted again from the palm oil with pure methanol. Partition coefficients of TP, TT and FFA (free fatty acids) were obtained by measuring the concentration of valuable compounds in the extract and the bottom fraction as in reference example 1. Table 6 summarizes the partition coefficient for the two stages methanol extraction.

TABLE 6

| Partition coefficient of FFA, TP and TT | | |
|---|---|---|
| Extraction stage | Average PC of TP and TT | PC of FFA |
| 1st stage | 0.29 | 0.85 |
| 2nd stage | 0.29 | 0.75 |

Step (c) Membrane Separation of the Extract

Materials and Methods

The METcell cross-flow filtration apparatus (Evonik Membrane Extraction Technology Ltd., London, U.K.) consisted of an 800 mL capacity feed vessel and a pumped recirculation loop through two to six cross-flow cells connected in series. The cross-flow system is shown schematically in FIG. 1. The mixing in the cross-flow cells was provided by flow from the gear pump (recirculation pump in FIG. 1): the flow was introduced tangentially to the membrane surface at the outer diameter of the membrane disk and followed a spiral flow pattern to a discharge point at the center of the filtration cell/disk. The nanofiltration membrane disks were conditioned with methanol at the operating pressure and temperature until a constant flux was obtained, to ensure that any preservatives/conditioning agents were washed out of the membrane, and maximum compaction of the membrane was obtained.

The test mixture was then permeated across each conditioned membrane disk at the desired operating temperature and pressure. Samples of feed, permeate and retentate solutions were collected for analysis.

Table 7 lists the membranes used for the study, and their respective nominal molecular weight cut-offs (MWCO). All membranes are organic solvent nanofiltration membranes made of P84 polyimide.

TABLE 7

| Membrane used for the screening with methanol | | | |
|---|---|---|---|
| Entry | Membrane Type | Membrane Nominal MWCO, g · mol−1 | Short Name |
| 1 | DuraMemTM | 500 | DM 500 |
| 2 | DuraMemTM | 300 | DM 300 |
| 3 | PuraMemTM | 280 | PM 280 |

FFA, TT and TP. By using these parameters the TP and TT and glycerides separation efficiency was evaluated.

(i) The flux of the solvent, J (measured in L·m-2·hr or LMH), was calculated using the following equation:

$$\text{Flux, } J = \left(\frac{V_P}{A_m t}\right) \quad \text{(Equation 1)}$$

where Vp is the volume (L) permeated through the membrane; Am is the membrane area (m2); and t (hr) is the time taken for the volume to permeate.

(ii) Rejection of a species is used to measure the ability of the membrane to separate that species between permeate and retentate solutions. It is defined by the following equation:

$$\text{Rejection (\%)} = \left(1 - \frac{\text{Permeate concentration}}{\text{Retentate concentration}}\right) \times 100\% \quad \text{(Equation 2)}$$

A good membrane performance is considered achieve when the flux is higher than 10 LMH, TP and TT rejection +95% and dry weight and FFA rejection values ideally lower than 50% but acceptable if lower than 80%.

Screening

Prior to characterizing the membranes, they were first conditioned with pure solvent at the desired filtration pressure and temperature to remove the conditioning agent present in the membranes. Afterwards, any residual solvent was drained, and a fixed volume of crude palm oil solution and solvent was mixed and placed in the feed tank. Methanol was selected as the process solvent for this work. The palm oil content was twice extracted with a oil:solvent ration of 1:2.

The membranes were then tested in continuous cross-flow at the specified operating pressure and temperature. Permeate and retentate samples were collected after 4 hours of filtration. Retentate and permeate samples were then analyzed for each membrane to determine membrane performance. Table 8 presents the data from the screening tests.

TABLE 8

| Screening experiment results with methanolic extract | | | | | | | | | |
|---|---|---|---|---|---|---|---|---|---|
| | DM 500 | DM 300 | PM 280 | DM 500 | DM 300 | PM 280 | DM 500 | DM 300 | PM 280 |
| Pressure, bar | | 30 | | | 20 | | | 20 | |
| Temperature, ° C. | | 30 | | | 30 | | | 40 | |
| Flux, LMH | 113.6 | 70.7 | 92.1 | 94.3 | 79.3 | 75.0 | 109.3 | 96.4 | 85.7 |
| Dry weight Rejection, % | 62.5 | 96.0 | 74.6 | 72.5 | 85.3 | 71.4 | 72.6 | 85.7 | 69.0 |
| FFA Rejection, % | 68.4 | 88.2 | 63.8 | 69.4 | 84.9 | 69.4 | 71.4 | 85.6 | 65.2 |
| Average TP and TT Rejection, % | 92.5 | 95.2 | 95.0 | 94.1 | 98.2 | 97.8 | 93.7 | 94.5 | 96.7 |

Results and Discussion

Membrane Performance

Membrane performance was evaluated by observing (i) the permeate flux through the membrane during a fixed period of time; and (ii) the rejection values of dry weight, DM 300 shows good rejection of all dissolved compounds in any chosen parameters. This membrane is suitable for a later step (d) to (f) for solvent recovery. Both DM 500 and PM 280 show both high permeate flux and low rejection for FFA and "dry weight" (an indirect measure of the glyceride content of the oil) indicating it is suitable for this separation step (c). Although both TP and TT rejections are high PM 280 would be the preferred membrane for a process to due to the difference in rejection between these compounds and co-extractable compounds. The most suitable operating pressure and temperature will be 20 bar and 30° C. due to higher values of TP and TT rejection.

Inventive Example 2: Batch and Diafiltration Process

Based on the results from experiments in inventive Example 1, a number of simulations were performed to assess if the identified membrane and operating conditions would be capable of providing a viable process.

The simulations were performed using a differential mass-balance model A batch and a fed-batch constant volume diafiltration were used evaluate the possibility of achieving 20 times enrichment of TP and TT in the final product.

An experiment was performed to assess the validity of the predictions from the mathematical model.

Materials and Methods

The same METcell cross-flow filtration apparatus (Evonik Membrane Extraction Technology Ltd., London, U.K.) was used as in inventive example 1. DM 500 and PM 280 were used as membranes.

Results and Discussion

Membrane Performance

Membrane performance was evaluated as described in inventive example 1.

Screening: Batch and Diafiltration

For the membrane characterization, the membrane was first conditioned with pure solvent at operating pressure and temperature to remove the conditioning agent present in the membranes. Afterwards, any residual solvent was drained, and a 0.8 L of an extract solution (generated from two sequential extractions of 1:2 palm oil to methanol) was placed in the feed tank. The membrane was then tested in continuous at operating pressure and temperature until it reach a constant flux. The experiment was then resumed applying first batch concentration process for TP/TT enrichment reducing the feed volume 10 times. Followed by diafiltration methodology for the FFA removal. This process consists in a continuous permeation of the solution rich in FFA and glycerides while fresh solvent is added at the same rate as the permeate flow-rate, such that the volume in the feed tank remains constant. Permeate and retentate samples were collected in the end point of the batch and diafiltration. The experiment had a total of 2 Diafiltration volumes for DM 500 and 3 for PM 280. The separation performance results achieved and the flux of the membranes during each test are described in Table 9.

TABLE 9

Summary of the membrane performance results during the batch and diafiltration.

| | DM 500 | | | PM 280 | | |
|---|---|---|---|---|---|---|
| | Membrane compaction | End Batch | End DF | Membrane compaction | End Batch | End DF |
| Pressure, bar | 30 | | | 20 | | |
| Temperature, ° C. | 30 | | | 30 | | |

TABLE 9-continued

Summary of the membrane performance results during the batch and diafiltration.

| | DM 500 | | | PM 280 | | |
|---|---|---|---|---|---|---|
| | Membrane compaction | End Batch | End DF | Membrane compaction | End Batch | End DF |
| Flux, LMH | 68.1 | 32.9 | 34.6 | 67.7 | 23.8 | 14.6 |
| Dry weight | 73.2 | 68.8 | 68.4 | 54.3 | 65.5 | 63.9 |
| Rejection, % | | | | | | |
| FFA Rejection, % | 72.1 | 60.9 | 66.2 | 40.2 | 39.0 | 22.5 |
| Average TP and TT Rejection, % | 92.5 | n/a | 94.3 | 99.0 | 90.9 | 81.3 |
| TP and TT final enrichment | 4 | n/a | 20 | 4.2 | n/a | 35 |
| FFA Removal, % | n/a | 18.2 | 46.1 | n/a | 80.1 | 97.1 |

n/a—result not available

Both PM 280 and DM 500 provide a high TP and TT enrichment. Although the flux for DM 500 is higher during the process PM 280 can remove up to 97% of FFA from the extract.

Figure 2:
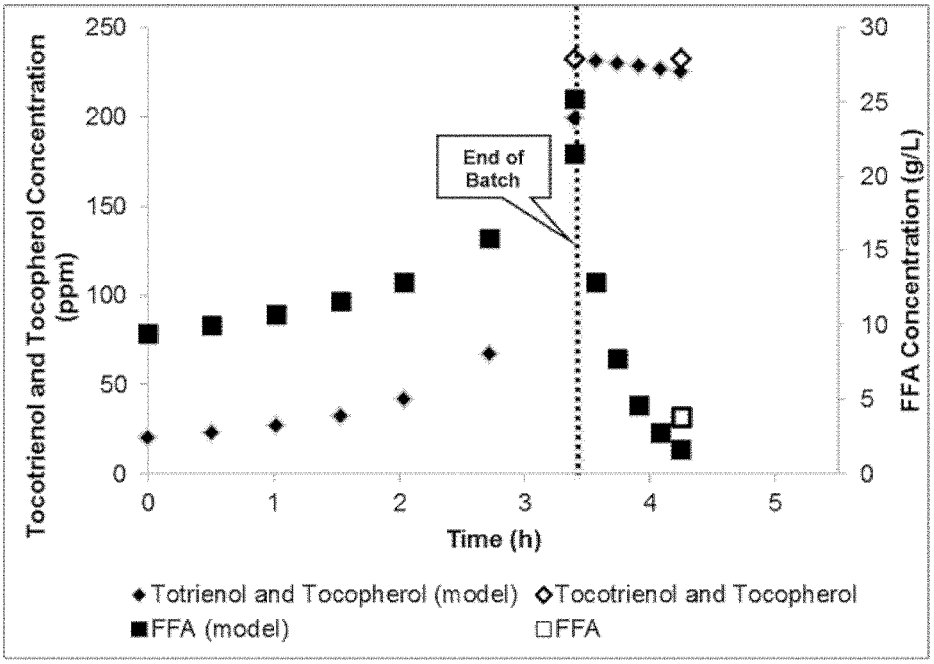
FIG. 2: Model predictions versus experimental data for PM 280

Using PM 280 in a batch concentration process and 3 diafiltration volumes are enough to achieve a good TP and TT enrichment as well removing the FFA in the extract. Model predictions are consistent with measured values as seen in FIG. 2.

Summary of the Examples

The examples and reference examples show, that the process of the invention is well suited to obtain:

As product 1: a highly enriched and pure vitamin E fraction, wherein the TT and TC ratio can be adjusted by selection of an appropriate solvent as shown in the reference examples.

As product 2: a pure oil fraction because vitamin E components as well as FFA were extracted in step (a) as shown in the reference examples.

The examples also show that specific membranes like DM 300 are available to smoothly recover the solvents from the final phases without the need of high temperature treatment of the temperature sensitive vitamin E components.

The examples together with the information provided in the description allow a person skilled in the art to adjust the process to other crude oils.

The invention claimed is:

1. A process, comprising:

(a) mixing a fatty acid oil mixture, comprising vitamin E components, with an immiscible organic solvent to form a heterogeneous, two-phase mixture;

(b) separating the resulting two-phase mixture to provide a first phase comprising a vitamin E depleted fatty acid oil mixture and a second phase comprising the organic solvent, vitamin E components and optionally at least one impurity;

(c) passing the second phase obtained in step (b) across at least one selective membrane, wherein a retentate forms comprising greater than 50% of the desired vitamin E components present in the second phase, and a permeate forms comprising the solvent and any component that is not retained by the membrane;

(d) removing the organic solvent from the retentate obtained in step (c) to provide as product 1 a composition enriched in at least one vitamin E component compared to the fatty acid oil mixture, (e) optionally removing the organic solvent from the permeate obtained in step (c) to form as product 3 an impurity composition, and (f) optionally separating the solvent from the first phase obtained in step (b) to obtain as product 2 a fatty acid oil mixture depleted in vitamin E components compared to the raw material;

wherein the fatty acid oil mixture comprises triglyceride oils, phospholipid oils, or any combination thereof; and wherein the membrane used in step (c) is characterized by a rejection $R_{Vit}$ of the target vitamin E components which is greater than the membrane rejection of the at least one impurity species $R_{imp}$.

2. The process according to claim 1, characterized in that the process comprises a solvent selection step and a solvent screening step, wherein in the solvent screening step partition coefficients PC for organic solvents or mixtures thereof are determined, optionally for different mixing ratios of organic solvent to fatty acid oil mixture, by a process comprising the following steps:

Extracting a sample of a fatty acid oil mixture with an organic solvent or mixture of organic solvents to obtain a bottom fraction and an extract fraction, Measuring the concentration of at least one tocopherol and at least one tocotrienol in the bottom fraction as well as in the extract fraction, and Calculating partition coefficients PCTocotrienol=concentration of a tocotrienol in the extract/concentration of the same tocotrienol in the bottom fraction and PCTocopherol=concentration of a tocopherol in the extract/concentration of the same tocopherol in the bottom fraction, for at least one tocotrienol and at least one tocopherol comprised in the fatty acid oil mixture, and wherein in the solvent selection step an organic solvent is selected for use in step (a) which has a PCTocotrienol that is higher than the PCTocopherol for at least one mixing ratio of organic solvent to fatty acid oil mixture.

3. The process according to claim 2, characterized in that an organic solvent is selected for step (a) having a ratio of the PCTocotrienol to PCTocopherol for at least one mixing ratio of organic solvent to fatty acid oil mixture of from >1 to about 1000.

4. The process according to claim 1, further comprising at least one of the following:

wherein the process in step a) comprises a solvent extraction process selected from the group consisting of a counter-current equilibrium stage extraction processes, a crosscurrent equilibrium stage extraction process a co-current equilibrium stage extraction process and a combination of at least two of these processes;

wherein step (a) of the process is performed at a pressure of (i) 1-10 atm absolute when organic solvents are used other than liquefied gases or supercritical gases, (ii) 1-80 atm absolute when an organic solvent system containing or consisting of liquefied gases is used, and (iii) 1-400 atm absolute when an organic solvent system containing or consisting of supercritical gases is used; and wherein the process in step (a) is performed at a temperature in the range −20° C. to 200° C.

5. The process according to claim 1, further comprising at least one of the following:

wherein the passing of the second phase obtained in step (b) across the at least one selective membrane in step (c) comprises diafiltration, cross-flow filtration, or a combination of diafiltration and cross-flow filtration;

wherein process step (c) is performed at a temperature ranging from about −10° C. to about 60° C. and wherein the filtration pressure in step (c) ranges from about 5 bar to about 70 bar.

6. The process according to claim 1, further comprising passing the retentate obtained in step (c) or product 1 obtained after step (d) across at least one second selective membrane to form a second retentate comprising enriched content of vitamin E components, and a second permeate comprising at least one impurity compound, wherein the at least one second selective membrane may be the same as, or different from, the at least one selective membrane.

7. The process according to claim 2, further comprising passing the retentate obtained in step (c) or product 1 obtained after step (d) across at least one second selective membrane to form a second retentate comprising enriched content of vitamin E components, and a second permeate comprising at least one impurity compound, wherein the at least one second selective membrane may be the same as, or different from, the at least one selective membrane.

8. The process according to claim 1, further comprising at least one of the following:

treating the vitamin E enriched composition obtained after step (c) or (d) with at least one adsorption process comprising at least one absorbent or adsorbent, at least one solvent extraction process, at least one distillation or evaporation process or at least one chromatography process;

recovering any solvent in steps (e) and/or (f) for re-use in step (a); and repeating the individual process steps (a) to (d) for a period of time ranging from about 10 minutes to about twenty hours.

9. The process according to claim 2, further comprising at least one of the following:

treating the vitamin E enriched composition obtained after step (c) or (d) with at least one adsorption process comprising at least one absorbent or adsorbent, at least one solvent extraction process, at least one distillation or evaporation process or at least one chromatography process;

recovering any solvent in steps (e) and/or (f) for re-use in step (a); and repeating the individual process steps (a) to (d) for a period of time ranging from about 10 minutes to about twenty hours.

10. The process according to claim 1, comprising at least one of the following:

wherein the initial fatty acid oil mixture has an acid value in the range 0.2 to 25 mg KOH/g;

wherein the initial fatty acid oil mixture comprises greater than 20%, triglycerides and/or phospholipid oils; and wherein the initial fatty acid oil mixture comprises greater than 100 ppm total tocopherols and tocotrienols.

11. The process according to claim 1, comprising at least one of the following:

wherein the initial fatty acid oil mixture comprises at least from about 10% to about 30% by weight of omega-3 fatty acids; and wherein the initial fatty acid oil mixture comprises vegetable oil, oil derived from marine sources, oil derived from algae, oil derived from microbes, animal fat, or animal oil.

12. The process according to claim 1, comprising at least one of the following:

wherein the at least one impurity is selected from the group consisting of free cholesterol, esterified cholesterol, sterols, esterified sterols, phenolic compounds, free fatty acids, monoglycerides, oxidation products, components that create unwanted smell or taste in the fatty acid oil mixture, vitamin A, vitamin D, astaxanthin, canthaxanthin, and other carotenoids; and wherein the at least one impurity is an environmental pollutant from the group consisting of polychlorinated biphenyls (PCBs), polybrominated diphenyl ethers (PBDEs), agrochemicals, chlorinated pesticides, polycyclic aromatic hydrocarbons (PAHs), hexachlorocyclohexanes (HCH), dichlorodiphenyltrichloroethane (DDT), dioxins, furans, and nonortho-PCBs.

13. The process according to claim 1, wherein the organic solvent comprises aliphatic hydrocarbons, aromatic hydrocarbons, ketones, esters, alcohols, liquefied gases, supercritical gases or mixtures thereof.

14. The process according to claim 1, wherein the at least one selective membrane comprises a material selected from the group consisting of polyethylene, polypropylene, polytetrafluoroethylene (PTFE), polyvinylidene difluoride (PVDF), polysulfone, polyethersulfone, polyacrylonitrile, polyamide, polyimide, polyamideimide, polyetherimide, cellulose acetate, polyaniline, polypyrrole, polyetheretherketone (PEEK), polybenzimidazole, and mixtures thereof.

15. The process according to claim 12, comprising at least one of the following:

wherein the at least one selective membrane has a molecular weight cut-off ranging from about 150 g/mol to about 1,500 g/mol wherein the at least one selective membrane has a contact angle for water of more than 70° at 25° C.; and wherein the selective membrane is a polyimide membranes.

16. The process according to claim 1, wherein the permeate in step (c) comprises at least one of free cholesterol, esterified cholesterol, sterols, esterified sterols, phenolic compounds, oxidation products, components that create unwanted smell or taste in the oil mixture, vitamin A, vitamin D, astaxanthin, canthaxanthin, or other carotenoids with an increased concentration compared to the fatty acid oil mixture.

17. The process according to claim 1, further comprising purifying the vitamin E enriched composition obtained after step (c) or (d) using a method selected from the group consisting of HPLC, supercritical fluid chromatography, distillation, molecular distillation, short path evaporation, thin film evaporation, extraction, absorption, crystallisation and any combination thereof.

18. The process according to claim 1, wherein said vitamin E component is tocotrienol.

19. The process according to claim 3, wherein the ratio of the PCTocotrienol to PCTocopherol is from 2 to 50.

20. The process according to claim 4, wherein the process in step (a) is performed at a temperature in the range 20° C. to 100° C.

21. The process according to claim 5, comprising cross-flow filtration in step (c) with a linear velocity ranging from about 0.1 m/s to about 5 m/s.

22. The process according to claim 10, wherein the initial fatty acid oil mixture comprises greater than 60% triglycerides.

23. The process according to claim 10, wherein the initial fatty acid oil mixture comprises greater than 750 ppm total tocopherols and tocotrienols.

24. The process according to claim 10, wherein the initial fatty acid oil mixture comprises vegetable oil selected from the group consisting of palm oil, soybean oil, rapeseed oil, sunflower oil, peanut oil, cottonseed oil, palm kernel oil, coconut oil, olive oil, corn oil, grape seed oil, hazelnut oil, linseed oil, rice bran oil, safflower oil, sesame oil, almond oil, pecan oil, pistachio oil, walnut oil, castor oil, jojoba oil, shea oil and annatto oil.

25. The process according to claim 13, wherein the organic solvent is selected from the group consisting of primary alcohols and solvent mixtures containing said alcohols.

26. The process according to claim 15, comprising at least one of the following:

wherein the at least one selective membrane has a molecular weight cut-off ranging from about 300 g/mol to about 600 g/mol;

wherein the at least one selective membrane has a contact angle for water of more than 95° at 25° C.; and wherein the selective membrane is made of P84, whose CAS registry number is 9046-51-9, or P84HT whose CAS registry number is 134119-41-8, or mixtures thereof, which is optionally crosslinked, organic coated, or crosslinked and organic coated.

27. The process according to claim 26, wherein the selective membrane is coated with silicone acrylates as coating agents.

* * * * *